US005699625A

United States Patent [19]

Iguchi

[11] Patent Number: 5,699,625

[45] Date of Patent: Dec. 23, 1997

[54] APPARATUS FOR DRAINING LIQUID DROPS FROM TENTERING OVEN

[75] Inventor: Fumio Iguchi, Ibaraki, Japan

[73] Assignee: Oji-Yuka Synthetic Paper Co., Ltd., Tokyo, Japan

[21] Appl. No.: 699,057

[22] Filed: Aug. 9, 1996

[30] Foreign Application Priority Data

Oct. 19, 1995 [JP] Japan ..... HEI7-294979

[51] Int. Cl.[6] ..... F26B 19/00

[52] U.S. Cl. ..... 34/62; 34/106; 34/646; 34/658

[58] Field of Search ..... 34/61, 62, 104, 34/105, 106, 209, 210, 215, 223, 225, 231, 646, 658; 432/59; 264/322

[56] References Cited

U.S. PATENT DOCUMENTS

| | | | |
|---|---|---|---|
| 3,711,961 | 1/1973 | Spiegel et al. | 34/105 X |
| 4,104,769 | 8/1978 | Levy et al. | 34/646 X |
| 4,127,945 | 12/1978 | Nöthen et al. | 34/62 X |
| 4,420,854 | 12/1983 | Newton | 34/105 X |
| 5,059,265 | 10/1991 | Asakura | 156/64 |
| 5,158,637 | 10/1992 | Takashige et al. | 156/244.11 |
| 5,201,132 | 4/1993 | Jacob | 34/62 X |
| 5,287,637 | 2/1994 | Dixit et al. | 34/464 |
| 5,441,675 | 8/1995 | Souders | 264/25 |

*Primary Examiner*—John M. Sollecito
*Assistant Examiner*—Steve Gravini
*Attorney, Agent, or Firm*—Oblon, Spivak, McClelland, Maier & Neustadt, P.C.

[57] ABSTRACT

An apparatus for draining liquid drops from a tentering oven is described, which comprises a plurality of plenum ducts for heating and cooling a film and a tenter for stretching the film. The tentering oven has at least two partition walls between the heating and cooling zones of the oven and wherein each of the partition walls located above the tenter is fitted with a pan and a heater for heating the pan at the lower part thereof, with a blower being installed above the compartment defined by the partition walls.

2 Claims, 6 Drawing Sheets

APPARATUS FOR DRAINING LIQUID DROPS FROM TENTERING OVEN

BACKGROUND OF THE INVENTION

1. Field of the Invention

The present invention relates to an apparatus for draining liquid drops from tentering ovens which include a stretching hot air oven (including an annealing hot air oven) and a cooling furnace and which are used to manufacture biaxially stretched resin films such as biaxially stretched polypropylene (BOPP) films, biaxially stretched polystyrene (BOPS) films and synthetic papers. If resin additives such as heat stabilizers (antioxidants), antistatic agents, UV absorbers, flame retardants and lubricants that bleed and evaporate from the resin film, as well the water vapor in the air atmosphere are condensed by an abrupt drop in the temperature on the border between the heating and cooling zones of the tentering oven, drops will form and adhere to the surface of the film, thereby fouling it and reducing its transparency or introducing non-uniformity in the subsequent corona discharge treatment. The apparatus of the invention is provided in the tentering oven in order to avoid these problems.

2. Discussion of the Background

A thermoplastic resin film containing a fine inorganic powder is first stretched in a machine direction using the difference in peripheral speed among rolls; subsequently, at least one side of the longitudinally stretched film is melt-laminated with another thermoplastic resin film containing a fine inorganic powder; after cooling, the laminate is heated to a stretching temperature, then stretched transversely on a tenter and heat set; following further cooling, a surface of the heat set assembly is optionally subjected to corona discharge treatment, thereby producing a sheet of synthetic paper. This related process is described in U.S. Pat. No. 4,318,950 and FIG. 2 accompanying this patent shows an apparatus for producing such synthetic paper.

There is a related process for producing a low-temperature heat-sealed film suitable for use in packages such as cigarette cartons and candy boxes. The process comprises laminating a longitudinally stretched polypropylene film with a heat-melted film of a propylene-ethylene copolymer having a lower melting point than the polypropylene, stretching the laminate on a tenter in a transverse direction at a temperature lower than the melting point of the polypropylene but higher than the melting point of the copolymer and thereafter heat treating the biaxially stretched film laminate.

A related process for producing a pearly film comprises first stretching a resin film containing a fine inorganic powder in a machine direction on a series of rolls, then stretching the film in a transverse direction on a tenter and heat setting the biaxially stretched film (see U.S. Pat. No. 3,765,999).

In these methods of producing synthetic papers, low-temperature heat-sealed films and pearly films, the temperature of the annealing hot air oven is set to be slightly higher than that of the stretching hot air oven in the tentering oven. The stretching oven is sometimes an integral part of the heat treatment oven and, as shown in FIG. 1 (see FIG. 2 of Examined Japanese Patent Publication No. 9130/1992), a resin film 1 being supplied in these ovens is heated by a plurality of plenum ducts 2, 2, . . . (i.e., 9 plenums) which have a length substantially the same as the transverse width of the resin film 1 and which are positioned both above and below the resin film such that hot air as supplied from the ducts 2, 2, . . . is passed through discharge ports 3, 3, . . . to be blown against the resin film 1.

The hot air is supplied from conduits 5, 5, . . . to the plenum ducts and then passed through the discharge ports 3, 3, . . . to be blown against the resin film 1 to heat it.

The stretched film emerging from the stretching and heating zones enters a cooling zone, where it is cooled with air blown from plenum ducts (see Examined Japanese Patent Publication No. 63498/1991).

Stated more specifically with reference to FIG. 2 (corresponding to FIG. 9 in Examined Japanese Patent Publication No. 9130/1992), two rows of plenum ducts are provided in an annealing hot air oven 11, the upper row consisting of 8 plenum ducts and the lower row also consisting of 8 plenum ducts. A stretching hot air oven 10 also contains two rows of plenum ducts, the upper row consisting of 4 plenum ducts and the lower row consisting of 3 plenum ducts. The plenum ducts in the annealing hot air oven are interconnected with conduits 5 via holes in the top surfaces of individual plenum ducts; the plenum ducts in the stretching hot air oven are interconnected with another group of conduits 5 via holes in the top surfaces of those plenum ducts. The individual conduits 5 are supplied with air that has been heated after aspiration with a blower. The temperature of the heated air (hot air) is typically about 170° C. in the stretching hot air oven 10 and about 175° C. in the annealing hot air oven 11 if the film is made of polypropylene.

FIG. 3 shows the cooling furnace in the cooling zone. Air aspirated (corresponding to FIG. 1 in Examined Japanese Patent Publication No. 63498/1991) with a blower 6 passes through a main damper 8, then through pipes to enter upper ducts 2; part of the air passes through a main damper 9 to be fed into lower ducts 2. Another part of the air is directed to nozzles 20 which cool the edges of the resin film 1 as it emerge from the annealing furnace 19 to enter the cooling furnace 18.

The cooling air passing through the main dampers 8 and 9 then passes through sub-dampers 10*a* and 10*b*. The portion of the air that has passed through the sub-damper 10*a* then passes through branching dampers 11*a*, 11*b*, . . . 11*i* to be fed into compartments A, B, . . . I of each of the ducts $2b_1$, $2b_2$, $2b_3$, and $2b_4$ or conduits interconnecting these compartments such that the cooling air emerging from the individual compartments is blown against the resin film 1. The other portion of the air which has passed through the sub-damper 10*b* is directed to unsegmented ducts $2b_5$, $2b_6$, $2b_7$ and $2b_8$ and emerges from the discharge ports to be blown against the resin film 1. The cooling zone has a temperature of 30° to 100° C.

The resin film which was typically at 160° C. in the annealing over is cooled in the cooling furnace such that it leaves the exit thereof at 30° to 50° C.

If necessary, a surface of the stretched film is subjected to corona discharge treatment.

For a better cooling efficiency, a pair of partition walls are provided in order to form an intermediate compartment between the heating/stretching zone (annealing zone) and the cooling zone.

On account of the abrupt temperature change between the heating and the cooling zone, liquid drops will generate as already described above. In order to ensure that such liquid drops will not adhere to the surface of the stretched film, a liquid drop trapping cloth 22 is stretched between the lower parts of the partition walls 21*a* and 21*b* defining the intermediate compartment 21 (see FIGS. 4(*a*) and 4(*b*)) such that liquid drops flowing down the partition walls and a baffle plate 23 will adhere to the cloth 22 while at the same time the liquid vapors are aspirated with a blower to go outside the oven through the ceiling 27 of the intermediate compartment.

A problem with this approach of using the liquid drop trapping cloth is that it must be replaced frequently at short intervals of 1 to 2 weeks in summer where hot and humid conditions are dominant and at intervals of one month even in winter where cold and dry conditions prevail. The operations of cloth replacement reduces the yield of films since it takes about 12 hours for the tentering oven to be cooled and for the process of film production to resume the steady state.

SUMMARY OF THE INVENTION

An object, therefore, of the present invention is to provide an apparatus with which liquid drops can be easily drained from a tentering oven without using a liquid drop trapping cloth.

This object of the present invention can be attained by an apparatus for draining liquid drops form a tentering oven comprising a plurality of plenum ducts for heating and cooling a film and a tenter for stretching the film, wherein said tentering oven has at least two partition walls located between a heating zone and a cooling zone of the tentering oven and wherein each of the partition walls located above the tenter is fitted with a pan and a heater for heating said pan at the lower part thereof, with a blower being installed above the compartment defined by said partition walls.

That is, the object can be attained by an apparatus for draining liquid drops from a tentering oven, the apparatus comprising:

a plurality of plenum ducts for heating and cooling a film and a tenter for stretching the film;

wherein:

said tentering oven has at least two partition walls located between a heating zone and a cooling zone of the tentering oven, said at least two partition walls defining a compartment;

each of the partition walls is located above the tenter and is fitted with a pan and a heater for heating said pan at the lower part thereof; and a blower is installed above the compartment defined by said at least two partition walls.

BRIEF DESCRIPTION OF THE DRAWINGS

A more complete appreciation of the invention and many of the attendant advantages thereof will be readily obtained or the same becomes better understood by reference to the following detailed descriptions when considered in connection with the accompanying drawings, wherein.

DESCRIPTION OF THE PREFERRED EMBODIMENT

The thermoplastic resin of which the film is to be made may be exemplified by polypropylene, polyamides, polyethylene terephthalate, polyethylene, polyvinyl chloride, polystyrenes, polycarbonates, etc. These resins may contain the fine powders of inorganic materials such as talc, calcined clay, calcium carbonate and titanium oxide, and other additives such as heat stabilizers, lubricants, antistatic agents, UV absorbers and flame retardants.

Temperature Distribution in Tentering Oven

For the temperature distribution in the case where the film is made of polypropylene, see above. If the film is made of polycarbonate or polyamide (nylon 6), the temperature in the stretching/heating zone ranges from 100° to 130° C. whereas the temperature in the cooling zone ranges from 30° to 80° C.

Liquid Drop Draining Apparatus

Figure 5:
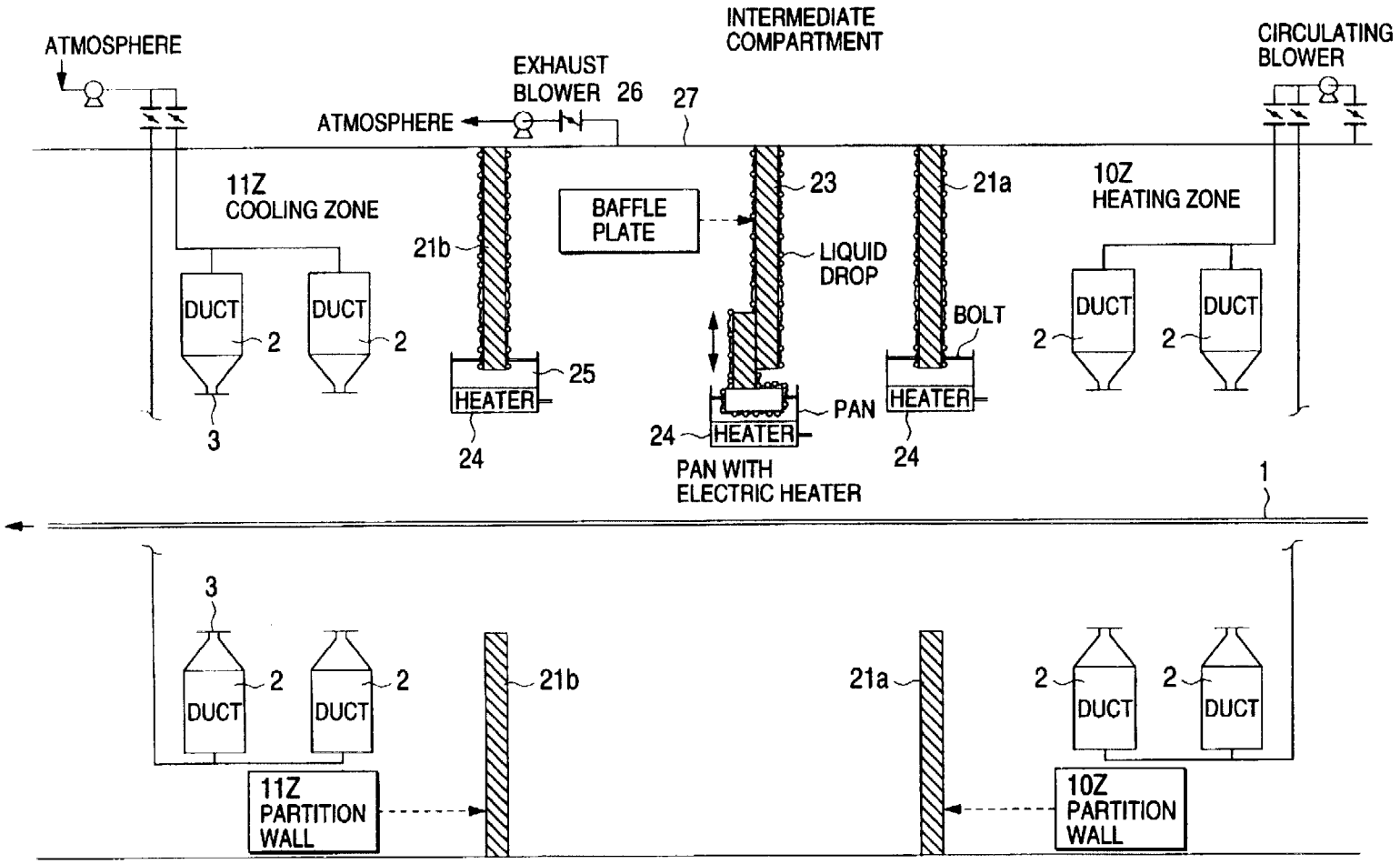
FIG. 5 is a side view schematically showing the intermediate compartment of a tentering oven from which liquid drops are to be drained with the apparatus of the invention.
Figure 6:
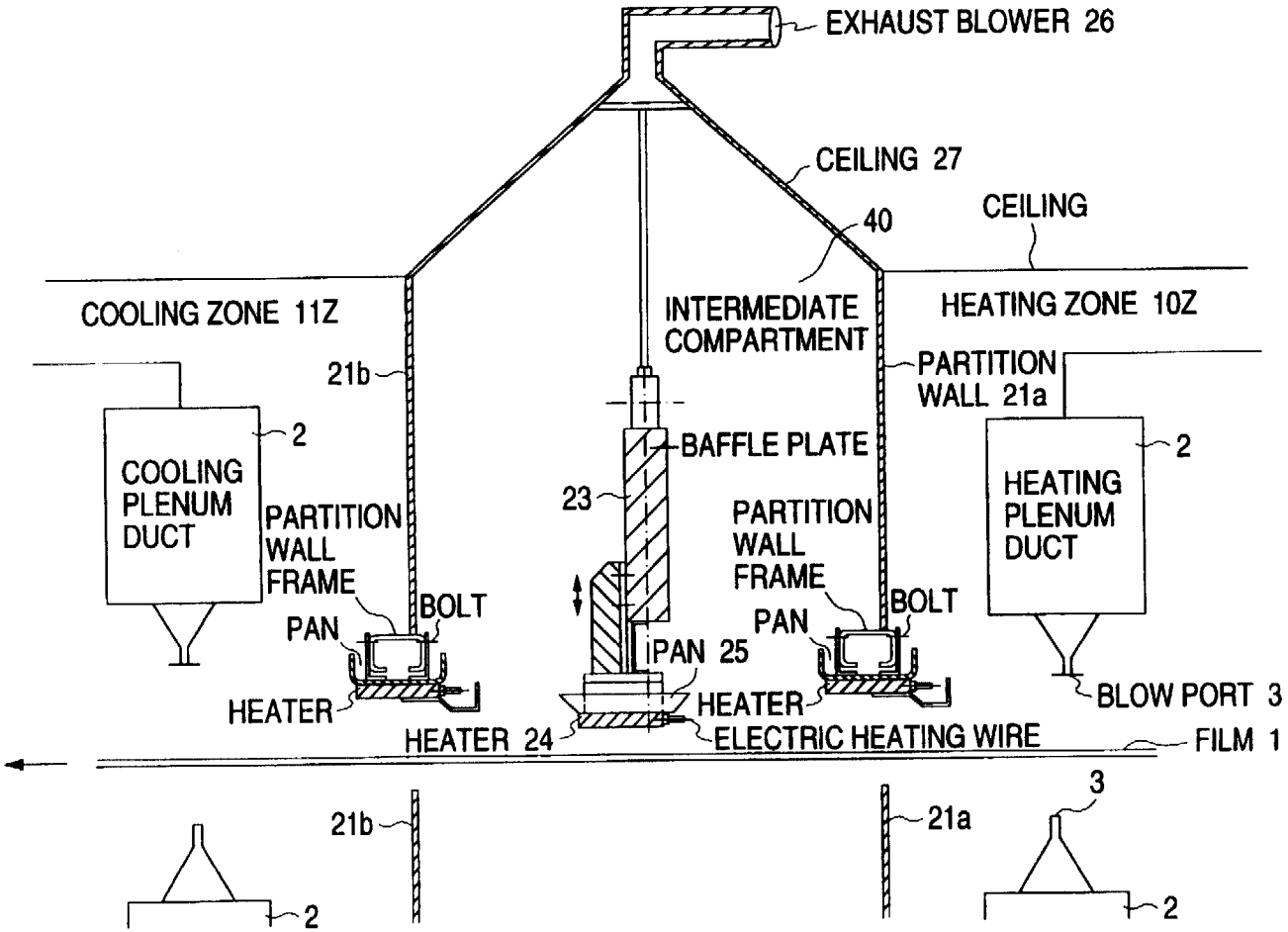
FIG. 6 is another side view schematically showing the intermediate compartment of the liquid drop draining apparatus of the invention.

Referring now to the drawings, wherein like reference numerals designate identical or corresponding parts throughout the several views, as shown in FIGS. 5 and 6, the apparatus has a partition wall 21*a* (closer to a heating zone 10Z), an intermediate compartment dividing plate 23 (baffle plate for preventing the flow of hot air from the heating zone 10Z to a cooling zone 11Z) and a partition wall 21*b* (closer to the cooling zone 11Z), which are located above the tenter (in the same position as film 1), and a heater 24 fitted in a pan 25 is provided under each of the partition walls 21*a*, 21*b* and the plate 23.

On account of the heaters 24 (130° to 150° C.) in the pans, the lower parts of the metallic partition walls and baffle plate are heated to 130°–150° C. such that liquid drops condensed on their surfaces will flow down to collect in the pans and thereafter evaporate again due to the heat provided by the heaters 24. The liquid vapors in the intermediate compartment 40 of the tentering oven are forced out of the oven by means of a blower 26 provided on top of the intermediate compartment. The blower is capable of aspirating 0.01 to 3 $m^3$ of vapors per minute.

The intermediate compartment has a ceiling 27 which slopes upward by 35 to 70 degrees to ensure that condensed or liquefied drops can easily be guided into pans 25 by flowing down the partition walls 21*a*, 21*b* and the baffle plate 23.

The following example is provided for the purpose of further illustrating the present invention but is in no way to be taken as limiting.

EXAMPLE

Figure 1:
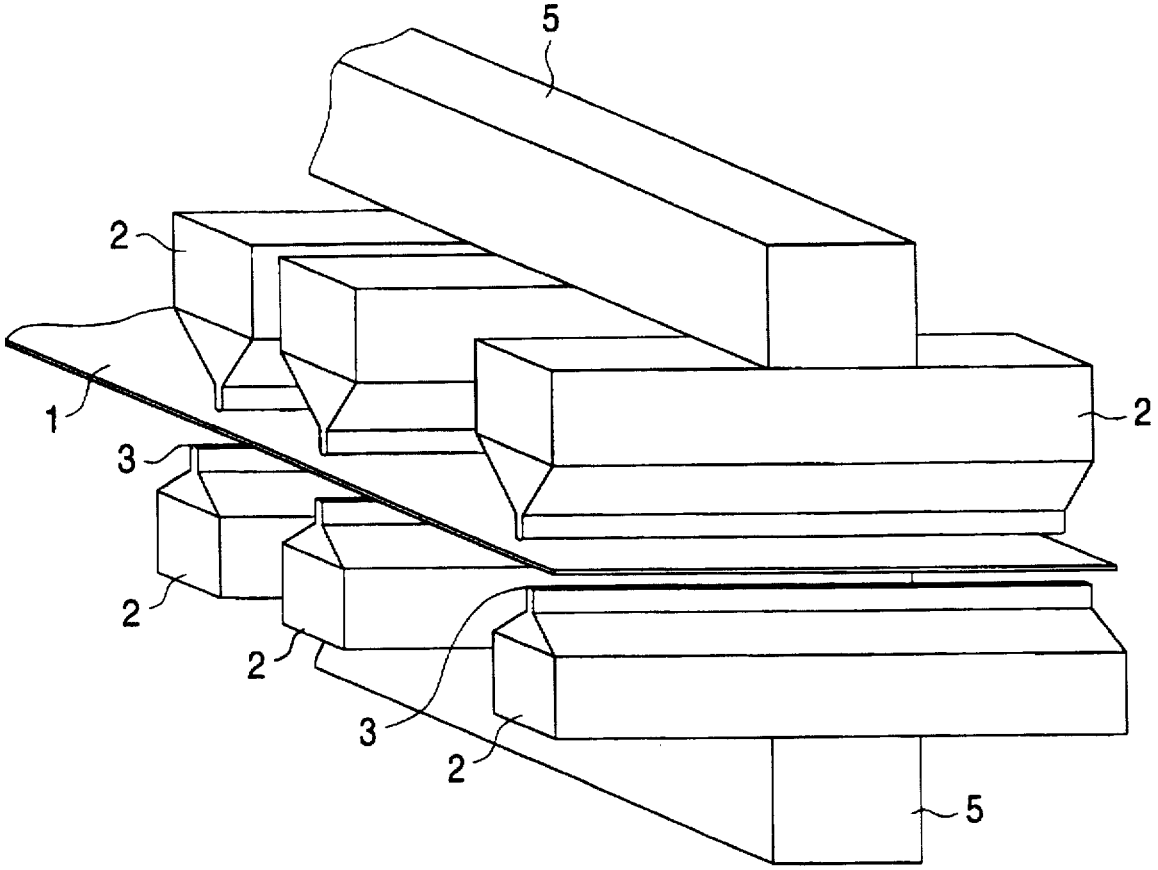
FIG. 1 is a perspective view showing the interior of a related heating oven.
Figure 2:
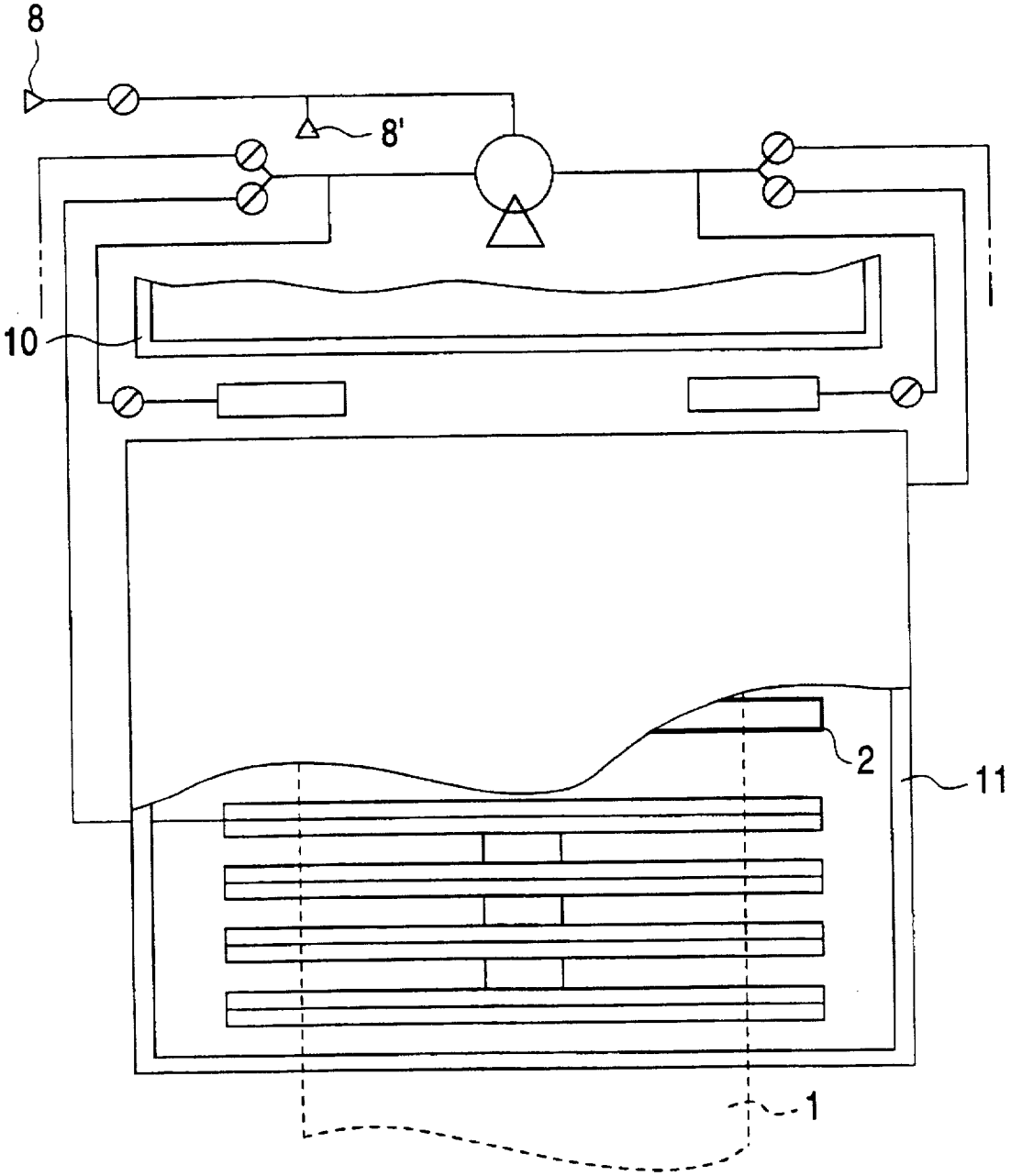
FIG. 2 is a plan view of a related annealing hot air oven.
Figure 3:
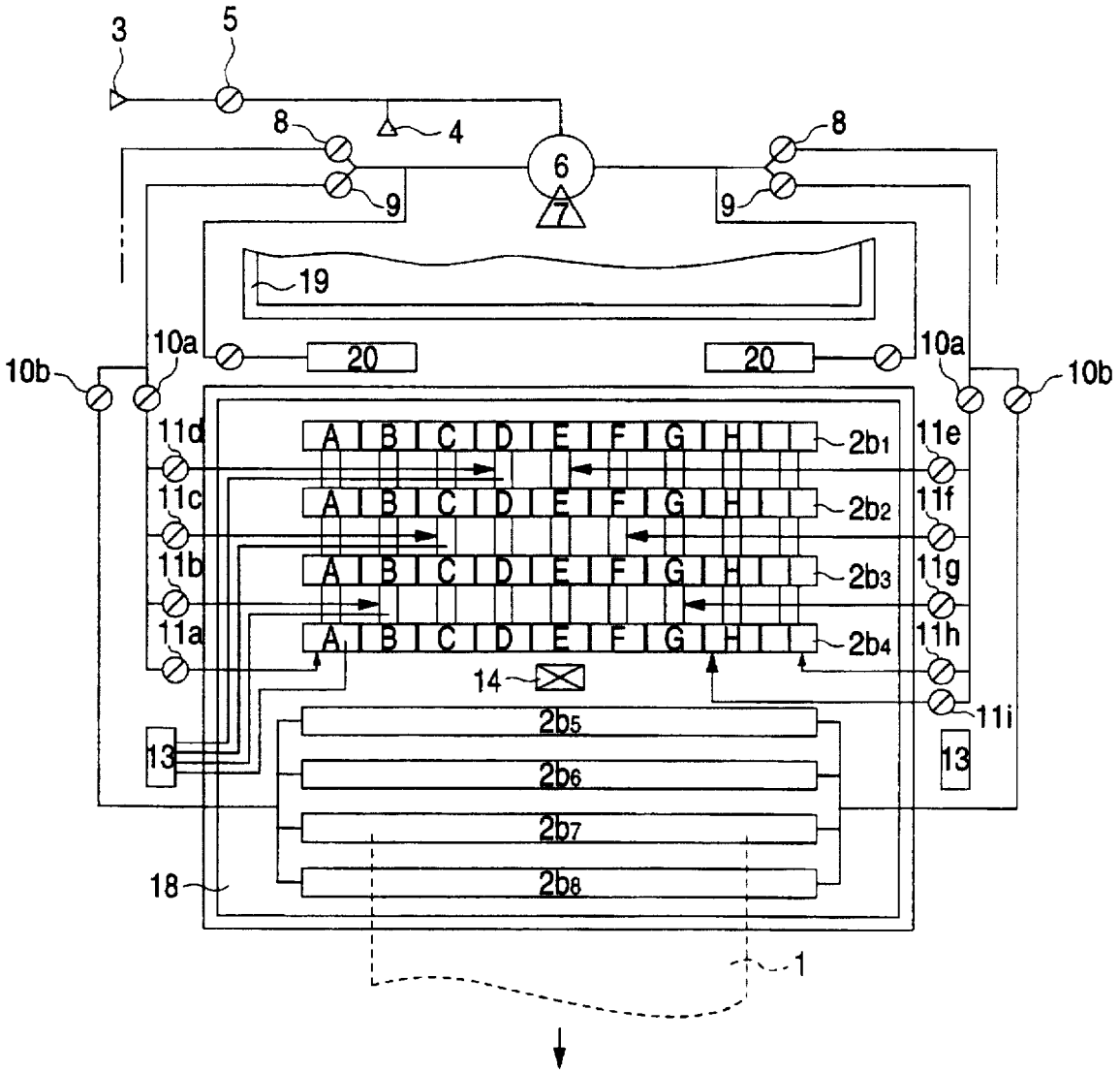
FIG. 3 is a plan view of a related cooling furnace.
Figure 4:
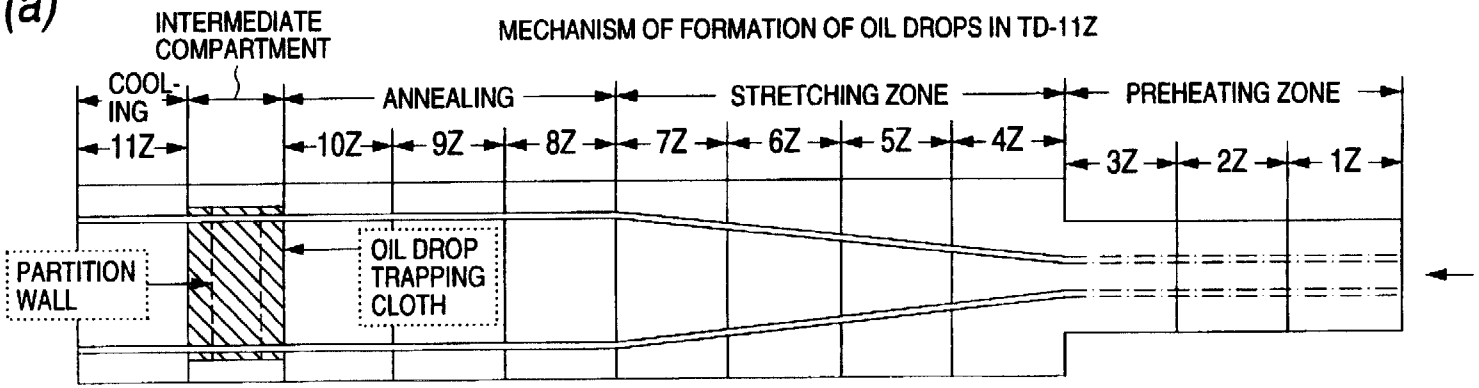
FIGS. 4(*a*) and 4(*b*) show a related tentering oven schematically in both a top view (FIG. 4(*a*)) and a side view (FIG. 4(*b*))
Figure 4:
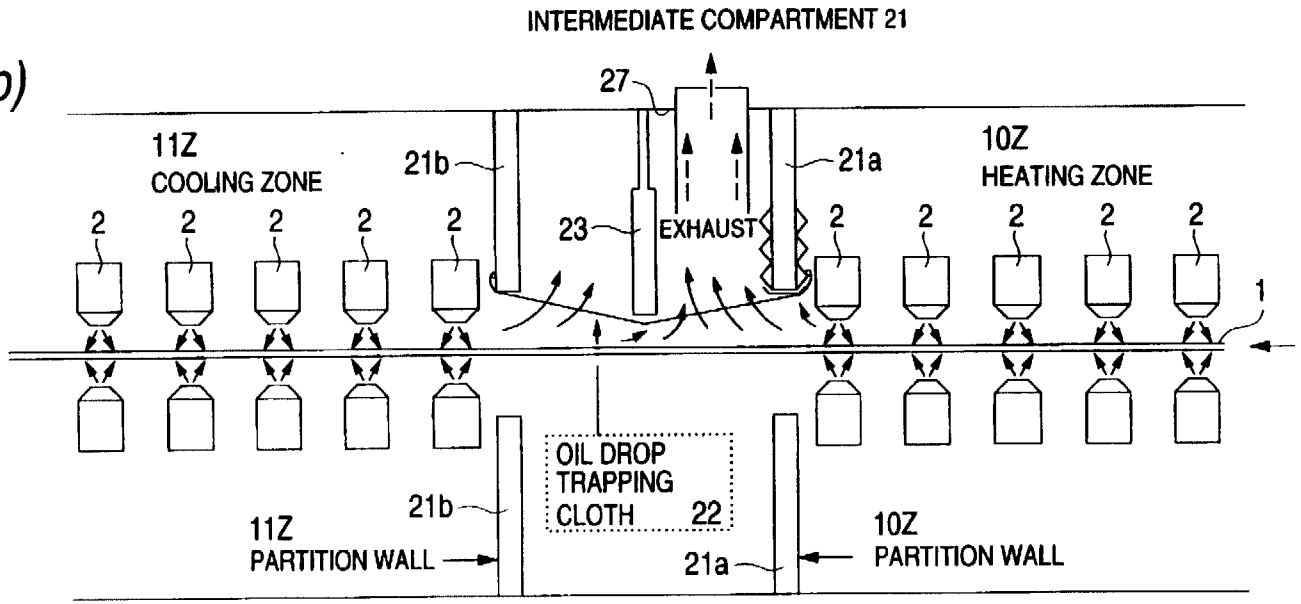

The invention was implemented using a tentering oven of the type shown in FIG. 1 (corresponding to FIG. 2 in Examined Japanese Patent Publication No. 9130/1992) and FIGS. 2 and 3 and which had a liquid drop draining apparatus of the type shown in FIGS. 5 and 6. Stated more specifically, the stretching hot air oven used a total of 13 plenum ducts, 7 of which were in the upper row and 6 in the lower row; the annealing hot air oven used 4 pairs of plenum ducts.

A composition consisting of 90 parts by weight of polypropylene ("Mitsubishi Polypro MA-6", trade name of Mitsubishi Chemical Corporation), 10 parts by weight of high-density polyethylene ("Mitsubishi Polyethy EY-40", trade name of Mitsubishi Chemical Corporation), 15 parts by weight of calcium carbonate and 0.15 part by weight each of Yoshinox BHT and Mark 329 (antioxidants) was melt kneaded in an extruder, extruded into a film through a die at 200° C., and cooled to about 50° C. The cooled film was then heated to about 135° C. and stretched by a stretch ratio of 5 in machine direction using the difference in peripheral speed among rolls.

In a separate step, 100 parts by weight of polypropylene ("Mitsubishi PolyproMA-6") was mixed with 80 parts by weight of calcium carbonate particles (average size: 1.5 μm), 10 parts by weight of titanium oxide particles (average size: 1 μm), 0.1 part by weight each of Yoshinox BHT and Mark 329 (antioxidants) and 0.1 part by weight of oleic acid. The resulting composition was melt kneaded in two other extruders and extruded into films through dies at 200° C. to laminated both sides of the longitudinally stretched film. The laminate was then cooled to a temperature 20° C. higher than room temperature and directed into a hot air oven at about 170° C., where it was reheated to about 155° C. and stretched transversely by a stretch ratio of 10 on a tenter. Subsequently, the stretched laminate was passed through an oven at 175° C. to be heat set (the laminate had a temperature of 160° C.).

The edges of the thus heat set (annealed), biaxially stretched laminate were cooled with air. Thereafter, the laminate was directed into a cooling furnace having 8 pairs of plenum ducts as shown in FIG. 3 (corresponding to FIG. 1 in Examined Japanese Patent Publication No. 63498/1991) and the laminate was cooled to 45° C. with air that was discharged through the individual ducts at the same pressure of 40 mmAq. The cooled laminate was then subjected to corona discharge treatment (100 W/hr), had the edges slit off and wound up over a length of 500 m.

The thus produced stretched laminate had a three-layer structure with a transverse width of 300 cm, in which the biaxially stretched film forming the intermediate layer (base layer) had a thickness of 70 μm whereas the uniaxially stretched films forming the top and bottom layers each had a thickness of 10 μm. The three-layer laminate was white in color and had good printability and writability.

This laminate had an apparent density of 0.78 g/cc and contained a number of fine voids not only in the base layer but also in the top and bottom layers, which also had a number of fine cracks in the surfaces.

At the end of the wind-up operation, the winder which has taken up the laminate (synthetic paper) rotates in reverse direction so that the roll of an empty winder starts to take up the laminate, thus enabling continuous production of the synthetic paper.

The intermediate compartment between the annealing hot air oven and the cooling zone was degassed at a rate of 0.05 $m^3$/min by means of a blower.

Periodic inspection was scheduled at the 8th month of production, so the extruders and the tenter were shut down. When the temperature in the tentering oven reverted to room temperature (30° C.), the pans under the partition walls and the baffle plate in the liquid drop draining apparatus were checked for the presence of any deposits. Deposits in a thickness of about 5 μm were found in the pan under partition wall in the cooling zone and very few spots were found in the pan under the baffle plate but no deposits were found in the pans under the partition walls in the annealing zone.

The three-layer laminate (synthetic paper) produced in the 8-month period had no sign of foreign matter (i.e., thermally deteriorated liquid drops would form carbon dust which adhere to the surface of the laminate).

Liquid drops forming in a tentering oven are sufficiently drained from the oven to ensure the production of stretched films having a good appearance.

The heretofore used liquid drop trapping cloth is not employed and the need for cloth replacement is totally eliminated. Hence, the production of stretched films is not interrupted by frequent replacement jobs.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States:

1. An apparatus for draining liquid drops from a tentering oven, the apparatus comprising:

a plurality of plenum ducts for heating and cooling a film and a tenter for stretching the film;

wherein:

said tentering oven has at least two partition walls located between a heating zone and a cooling zone of the tentering oven, said at least two partition walls defining a compartment;

each of the partition walls is located above the tenter and is fitted with a pan and a heater for heating said pan at the lower part thereof; and a blower is installed above the compartment defined by said at least two partition walls.

2. An apparatus according to claim 1, wherein a ceiling of the compartment defined by said at least two partition walls slopes upward by 35 to 70 degrees from the partition wall at either end toward a central part of the apparatus.

* * * * *